US012522937B2

(12) United States Patent
Park et al.

(10) Patent No.: US 12,522,937 B2
(45) Date of Patent: Jan. 13, 2026

(54) STEEL SHEET WITH IMPROVED YELLOWING RESISTANCE AND PHOSPHATABILITY AND MANUFACTURING METHOD THEREOF

(71) Applicant: POSCO, Pohang-si (KR)

(72) Inventors: Rho-Bum Park, Gwangyang-si (KR); Jong-Ho Kim, Gwangyang-si (KR)

(73) Assignee: POSCO, Pohang-si (KR)

( * ) Notice: Subject to any disclaimer, the term of this patent is extended or adjusted under 35 U.S.C. 154(b) by 362 days.

(21) Appl. No.: 17/785,845

(22) PCT Filed: Oct. 13, 2020

(86) PCT No.: PCT/KR2020/013936
§ 371 (c)(1),
(2) Date: Jun. 15, 2022

(87) PCT Pub. No.: WO2021/125522
PCT Pub. Date: Jun. 24, 2021

(65) Prior Publication Data

US 2023/0024286 A1 Jan. 26, 2023

(30) Foreign Application Priority Data

Dec. 17, 2019 (KR) ..... 10-2019-0168561

(51) Int. Cl.

| | |
|---|---|
| ***C25D 5/36*** | (2006.01) |
| ***C22C 38/00*** | (2006.01) |
| ***C22C 38/02*** | (2006.01) |
| ***C22C 38/04*** | (2006.01) |
| ***C23C 2/02*** | (2006.01) |
| ***C23C 2/34*** | (2006.01) |
| ***C25D 5/48*** | (2006.01) |

(52) U.S. Cl.
CPC ..... *C25D 5/36* (2013.01); *C22C 38/002* (2013.01); *C22C 38/02* (2013.01); *C22C 38/04* (2013.01); *C23C 2/024* (2022.08); *C23C 2/34* (2013.01); *C25D 5/48* (2013.01)

(58) Field of Classification Search
CPC ..... B05D 2202/10; B05D 2350/10; B05D 2350/65; B05D 7/52; C22C 38/002; C22C 38/02; C22C 38/04; C23C 2/024; C23C 2/26; C23C 22/22; C23C 28/30; C25D 5/36; C25D 5/48
See application file for complete search history.

(56) References Cited

U.S. PATENT DOCUMENTS

| | | | | |
|---|---|---|---|---|
| 4,298,661 | A | 11/1981 | Ikeno et al. | |
| 11,028,322 | B2 * | 6/2021 | Park | C25D 5/36 |
| 2002/0183224 | A1 | 12/2002 | Peterson et al. | |
| 2013/0260141 | A1 | 10/2013 | Hoshino et al. | |
| 2015/0013716 | A1 | 1/2015 | Masuoka et al. | |
| 2016/0369406 | A1 | 12/2016 | Hoshino et al. | |
| 2018/0282877 | A1 | 10/2018 | Tachiki et al. | |
| 2020/0190610 | A1 | 6/2020 | Nakamura et al. | |
| 2020/0270521 | A1 | 8/2020 | Park et al. | |

FOREIGN PATENT DOCUMENTS

| | | | |
|---|---|---|---|
| CN | 101445929 | A | 6/2009 |
| CN | 104246010 | A | 12/2014 |
| CN | 107429419 | A | 12/2017 |
| CN | 108431300 | A | 8/2018 |
| EP | 2980262 | A1 | 2/2016 |
| JP | 2003-129261 | A | 5/2003 |
| JP | 2011-032529 | A | 2/2011 |
| JP | 2018-537592 | A | 12/2018 |
| KR | 10-1995-0018657 | A | 7/1995 |
| KR | 10-1998-0044917 | A | 9/1998 |
| KR | 10-2002-0052734 | A | 7/2002 |
| KR | 10-0805727 | A | 2/2008 |
| KR | 10-2009-0055463 | A | 6/2009 |
| KR | 10-2011-0046650 | A | 5/2011 |
| KR | 10-2011-0060352 | A | 6/2011 |
| KR | 10-2014-0099320 | A | 8/2014 |
| KR | 10-2016-0122265 | A | 10/2016 |
| KR | 10-2017-0060167 | A | 5/2017 |
| KR | 10-1786348 | B1 | 10/2017 |
| KR | 10-2017-0121281 | A | 11/2017 |
| WO | 2013/108785 | A1 | 7/2013 |
| WO | 2018/173287 | A1 | 9/2018 |

OTHER PUBLICATIONS

International Searc3936h Report dated Jan. 22, 2021 issued in International Patent Application No. PCT/KR2020/01 (with English translation).
Office Action issued in Chinese patent application 202080089913.9 dated Mar. 31, 2023.
Extended Search Report issued in European patent application 20901720.1 dated May 4, 2023.
Japanese Office Action dated Jul. 4, 2023 issued in Japanese Patent Application No. 2022-536685.

* cited by examiner

*Primary Examiner* — Jie Yang
(74) *Attorney, Agent, or Firm* — Morgan Lewis & Bockius LLP

(57) ABSTRACT

The present invention relates to a steel sheet with improved yellowing resistance and phosphatability, wherein the steel sheet contains 0.5% by weight or more of Mn, and contains 0.01 to 10 mg/m$^2$ of Ca+Mg, 0.01 to 10 mg/m$^2$ of P, 0.01 to 20 mg/m$^2$ of C, and 0.05 to 30 mg/m$^2$ of O as components excluding a steel component on the surface of the steel sheet after pickling, water rinsing, and drying. According to the present invention, in a manufacturing process of the steel sheet, the surface of the steel sheet is subjected to a chemical conversion treatment for improving phosphatability and yellowing resistance in a water-cooling section or a water-washing section, thereby having an effect of improving the surface quality of products using same and various subsequently treated products.

12 Claims, No Drawings

STEEL SHEET WITH IMPROVED YELLOWING RESISTANCE AND PHOSPHATABILITY AND MANUFACTURING METHOD THEREOF

CROSS-REFERENCE OF RELATED APPLICATIONS

This application is the U.S. National Phase under 35 U.S.C. § 371 of International Patent Application No. PCT/KR2020/013936, filed on Dec. 13, 2020, which in turn claims the benefit of Korean Application No. 10-2019-0168561, filed on Dec. 17, 2019, the entire disclosures of which applications are incorporated by reference herein.

TECHNICAL FIELD

The present disclosure relates to a steel sheet having improved yellowing resistance and phosphatability and a method of manufacturing the same, and more particularly, a steel sheet having improved yellowing resistance and phosphatability achieved by suppressing formation of an oxide film on a surface of the steel sheet after pickling and washing or thermal treatment and water-cooling of the steel sheet and a method of manufacturing the same.

BACKGROUND ART

A cold-rolled steel sheet is mainly subjected to a phosphate treatment and coating is then performed thereon to secure coating adhesion during a coating process, and the coating quality may be affected by uniformity, coverage, and coating amount of a phosphate film formed. In particular, factors frequently causing poor coating quality are insufficiency of uniformity of the phosphate film and insufficiency of coverage of the phosphate film. When the uniformity of the phosphate film is insufficient, stains may be formed on a surface of the phosphate film after coating, and when the coverage of the phosphate film is insufficient, corrosion resistance may be reduced. Accordingly, uniform reactivity between base steel and a phosphate solution is required to secure the uniformity of the phosphate film.

To this end, a steel sheet manufacturer should manufacture a cold-rolled steel sheet having characteristics in which an entire surface of a product is uniform, and a product processor should optimize phosphate treatment conditions such that a uniform phosphate reaction occurs during a chemical conversion treatment. In addition, a steel sheet having excellent reactivity with a phosphate solution needs to be manufactured to address an issue of insufficient coverage occurring in the case that a phosphate film is not formed.

However, a cold-rolled steel sheet may be oxidized during a manufacturing process to form an oxide film on a surface thereof. Such an oxide film may be formed to be thick or thin depending on differences in a steel composition, a position of the steel sheet, and operating conditions, and may affect uniformity and coverage of the phosphate film when a phosphate treatment is performed by a product processor. This is because the oxide film interferes with a reaction between the steel sheet and the phosphate solution. When the oxide film has a non-uniform thickness, the phosphate film may also formed to have a non-uniform thickness. When the oxide film has a high thickness, the phosphate film may not be formed or the coverage may be insufficient, resulting in deterioration of the coating quality. In addition, when the oxide film has a high thickness, yellowing may be observed in the cold-rolled steel sheet itself and brightness may be decreased to spoil an appearance of the cold-rolled steel sheet. In particular, high-strength steel containing a relatively large amount of silicon (Si) or manganese (Mn) may have low oxidation resistance, so that yellowing may easily occur.

Patent Documents 1 to 3 propose techniques to address a phosphatability issue, among the above-mentioned issues.

Patent Document 1 discloses a method of adjusting steel compositions. When Mn is contained in a range of 2.3 to 2.5 wt %, a content of phosphorous (P) may be adjusted to be within a range of 0.01 to 0.07 wt %, and when Mn is contained in a range of 1.8 to 2.3 wt %, the content of P may be adjusted to be within a range of 0.07 to 0.09 wt %. However, the method of adjusting or changing the steel compositions may be an obstacle to securing basic manufacturing specifications of the steel sheet. In addition, the technique disclosed in Patent Document 1 is not preferable because an effect of improving not only phosphatability but also yellowing resistance is insignificant.

Patent Document 2 disclose a technique for manufacturing a cold-rolled steel sheet having excellent phosphatability by managing a sum total of copper (Cu) and chromium (Cr) elements to be 1000 ppm or less, managing a temperature of a final cooling section (FCS) of a continuous annealing line (CAL) to be 100° C. or less, and managing surface roughness to be within a range of 0.9 to 1.4 μm. However, the technique disclosed in Patent Document 2 has difficulty in managing roughness, and causes productivity to be decreased by 40 to 50% because low-speed driving for securing the temperature of the final cooling section (FCS) is unavoidable.

In Patent Document 3, a surface of a steel sheet was further coated with copper at a concentration of 0.2 to 20 $mg/m^2$ to improve phosphatability. However, coating with copper components resulted in dark appearance and yellowing. In addition, an effect of improving phosphatability was insignificant.

Patent Documents 4 to 7 propose techniques for addressing a yellowing issue, among the above-mentioned issues.

Patent Document 4 discloses a technique for preventing corrosion of a hot-rolled steel sheet during a washing process by neutralizing pH of a washing solution using sodium hydroxide, and Patent Document 5 discloses a stain and rust inhibitor for pickling a steel plate containing: 40 to 80 vol % of one or two or more of alkylamine, alkyldiamine, and alkyltetramine; 10 to vol % of tetrahydro-1,4-oxazine as a high temperature stabilizer; and at least 10 vol % of anhydrous citric acid as a solution stabilizer. Patent Document 6 disclose a technique for immobilizing a surface by treating with a solution of gluconate and polyquaternium compound, and Patent Document 7 discloses a technique for treating a discoloration inhibitor produced by the reaction of carboxylic acid and an alkali agent in a discoloration preventing tank following the pickling, and then removing the discoloration inhibitor in a washing tank.

However, the above-described techniques disclosed in the related art documents are not satisfactory in terms of yellowing prevention capability, and in particular, yellowing prevention capability for high-strength steel, which has recently been significantly increased in demand, is further insufficient.

RELATED ART DOCUMENTS

Patent Documents

KR 2009-0103172
KR 1996-0063070

KR 1993-0031046
KR 2000-0082171
KR 2006-0079405
US 2002-201705
JP 2001-319765

SUMMARY OF INVENTION

Technical Problem

An aspect of the present disclosure is to provide a technique for performing a phosphatability and yellowing resistance improving treatment in a water-cooling section or a water-rinsing section to improve phosphatability and yellowing resistance of a steel sheet.

Solution to Problem

According to an aspect of the present disclosure, a steel sheet having improved yellowing resistance and phosphatability is provided as a steel sheet containing 0.5 wt % or more of manganese (Mn). The steel sheet contains 0.01 to 10 mg/m$^2$ of calcium (Ca)+magnesium (Mg), 0.01 to 10 mg/m$^2$ of phosphorous (P), 0.01 to 20 mg/m$^2$ of carbon (C), and 0.05 to 30 mg/m$^2$ of oxygen (O) as components excluding a steel component on a surface of the steel sheet after pickling, water-rinsing, and drying.

A yellowness index of the steel sheet may be 3.0 or less.

The steel sheet may further contain at least one selected from the group consisting of nitrogen (N), chlorine (Cl), fluorine (F), sodium (Na), aluminum (Al), silicon (Si), sulfur (S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in a content of 10 mg/m$^2$ or less (excluding 0), excluding the steel component on the surface of the steel sheet.

According to another aspect of the present disclosure, a method of manufacturing a surface-treated steel sheet on the steel sheet having improved yellowing resistance and phosphatability includes the following operations.

(1) forming a flash plating layer including at least one of nickel (Ni), iron (Fe), copper (Cu), or zinc (Zn) on a steel sheet having improved yellowing resistance and phosphatability;
(2) forming a phosphating layer on the steel sheet having improved yellowing resistance and phosphatability;
(3) plating at least one of zinc (Zn), aluminum (Al), magnesium (Mg), and silicon (Si) on the steel sheet having improved yellowing resistance and phosphatability by hot-dip plating or electroplating;
(4) applying rust preventive oil to the steel sheet having improved yellowing resistance and phosphate treatment;
(5) applying a resin composition to the steel sheet having improved yellowing resistance and phosphatability to form a resin layer; and
(6) applying paint to the steel sheet having improved yellowing resistance and phosphatability to form a coating layer.

According to another aspect of the present disclosure, a steel sheet having improved yellowing resistance and phosphatability is provided as a steel sheet containing 0.5 wt % or more of manganese (Mn). The steel sheet contains 0.01 to 10 mg/m$^2$ of calcium (Ca)+magnesium (Mg), 0.01 to 10 mg/m$^2$ of phosphorus (P), 0.01 to 20 mg/m$^2$ of carbon (C), and 0.05 to 30 mg/m$^2$ of oxygen (O) as components excluding a steel component on a surface of the steel sheet after annealing, water-cooling, and drying.

A yellowness index of the steel sheet may be 3.0 or less.

The steel sheet may further contain at least one selected from the group consisting of nitrogen (N), chlorine (Cl), fluorine (F), sodium (Na), aluminum (Al), silicon (Si), sulfur (S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in a content of 10 mg/m$^2$ or less (excluding 0), excluding the steel component on the surface of the steel sheet.

A method of manufacturing a surface-treated steel sheet on the steel sheet having improved yellowing resistance and phosphatability includes the following operations.

(1) Forming a flash plating layer including at least one of nickel (Ni), iron (Fe), copper (Cu), or zinc (Zn) on a steel sheet having improved yellowing resistance and phosphatability;
(2) forming a phosphating layer on the steel sheet having improved yellowing resistance and phosphatability;
(3) plating at least one of zinc (Zn), aluminum (Al), magnesium (Mg), and silicon (Si) on the steel sheet having improved yellowing resistance and phosphatability by hot-dip plating or electroplating;
(4) applying rust preventive oil to the steel sheet having improved yellowing resistance and phosphate treatment;
(5) applying a resin composition to the steel sheet having improved yellowing resistance and phosphatability to form a resin layer; and
(6) applying paint to the steel sheet having improved yellowing resistance and phosphatability to form a coating layer.

Advantageous Effects of Invention

According to the present disclosure, in a process of manufacturing a steel sheet, a chemical conversion treatment for improving phosphatability and yellowing resistance may be performed on a surface of the steel sheet in a water-cooling section or a water-rinsing section, thereby having an effect of improving surface quality of products using the same and various subsequently treated products.

BEST MODE FOR INVENTION

Hereinafter, preferred embodiments of the present disclosure will be described with reference to various examples. However, the embodiment of the present disclosure may be modified in various other forms, and the scope of the present disclosure is not limited to the embodiments described below.

In general, a continuous annealing process line for manufacturing a cold-rolled steel sheet may be subdivided into two types of processes. According to one type of process, when steel sheets continuously enter an annealing furnace and a heat treatment on the steel sheets in a reducing atmosphere is completed, and then the steel sheets are cooled in a water-cooling section and exist the annealing furnace, skin pass mill (SPM) and oiling may be performed to manufacture cold-rolled steel sheets. According to the other type of process, similarly, when steel sheets continuously enter an annealing furnace and a heat treatment on the steel sheets in a reducing atmosphere is completed, and then the steel sheets are cooled in a water-cooling section and exit the annealing furnace, a post-treatment may be performed and SPM and oiling may be then performed to manufacture cold-rolled steel sheets. Conventionally, the post-treatment refers to a treatment in which an oxide present on a surface of a steel sheet is picked while the steel sheet passes through a picking section, a water-rinsing section and a metal coating section, and a water-rinsing section and, as necessary, metal (such as Ni, Zn, Cu, or Fe)-based coating may be performed.

An oxide film may be formed on a surface of a cold-rolled steel sheet manufactured through the above-described process. Such an oxide film is mainly formed by oxidizing steel components in a water-cooling section and a water-rinsing section in which a steel sheet is in contact with water. The oxide film may deteriorate quality of a post-treatment such as phosphatability, or the like, and may cause yellowing to spoil an appearance of the steel sheet. In particular, since high-strength steel contains a large amount of strongly oxidizing components such as manganese, silicon, aluminum, or the like, the high-strength steel may be easily oxidized, resulting in a high thickness of the oxide film and more frequent occurrence of yellowing.

Accordingly, the present disclosure provides a cold-rolled steel sheet having improved phosphatability and yellowing resistance by performing a chemical conversion treatment having an effect of promoting phosphate nucleation and an effect of suppressing yellowing on a surface of the steel sheet in at least one of a water-cooling section and a water-rising section.

According to an aspect of the present disclosure, a steel sheet having improved phosphatability and yellowing resistance, as a steel sheet containing 0.5 wt % or more of manganese (Mn), may contain 0.01 to 10 mg/m$^2$ of calcium (Ca)+magnesium (Mg), 0.01 to 10 mg/m$^2$ of phosphorous (P), 0.01 to 20 mg/m$^2$ of carbon (C), and 0.05 to 30 mg/m$^2$ of oxygen (O) as components excluding a steel component on a surface of the steel sheet after pickling, water-rinsing, and drying.

According to another aspect of the present disclosure, a steel sheet having improved yellowing resistance and phosphatability, as a steel sheet containing 0.5 wt % or more of manganese (Mn), may contain 0.01 to 10 mg/m$^2$ of calcium (Ca)+magnesium (Mg), 0.01 to 10 mg/m$^2$ of phosphorus (P), 0.01 to 20 mg/m$^2$ of carbon (C), and 0.05 to 30 mg/m$^2$ of oxygen (O) as components excluding a steel component on a surface of the steel sheet after annealing, water-cooling, and drying.

In a steel sheet containing Mn in a content of less than 0.5 wt %, an oxide film may not be severely formed during water-cooling and water-rinsing, so that an additional treatment is not required. Meanwhile, in a steel sheet containing Mn in a content of 0.5 wt % or more, steel components may react with moisture and oxygen during water-cooling and water-rinsing to form a large amount of oxide film, so that phosphatability, Ni flash treatment ability, paintability, or the like, may be deteriorated and yellowing may occur in a subsequent process, and thus, an additional treatment is required. Accordingly, in the present disclosure, a steel sheet containing, among components of the steel sheet, Mn in an amount of, in more detail, 0.5 wt % or more may be applied as abase material for improving phosphatability and yellowing resistance.

The steel sheet having improved phosphatability and improved yellowing resistance according to an example embodiment may contain Ca, Mg, P, C, and O as components excluding the steel component on the surface of the steel sheet. Ca, Mg, P, and C may be components when a composition of a chemical conversion solution contained in cooling water of the water-cooling section and rinsing water of the water-rinsing section is dried and then remain on the surface of the steel sheet after annealing the steel sheet, and O may be detected from the composition of the chemical conversion solution included in the cooling water and the rinsing water and an oxide component inevitably formed on the surface of the steel sheet. Ca, Mg, P, C, and O may be attached to the surface of the steel sheet in a predetermined amount after water-cooling and water-rinsing, resulting in improved phosphatability and yellowing resistance of the steel sheet.

After water cooling, water-washing, and drying, the components may adhere to the surface of the cold-rolled steel sheet in a total content of Ca and Mg, for example, in a content of, in detail, 0.01 to 10 mg/m$^2$ of Ca+Mg. When a coating weight of Ca+Mg is less than 0.01 mg/m$^2$, sufficient phosphatability may not be exhibited. When the coating weight of Ca+Mg is greater than 10 mg/m$^2$, there is no further improvement effect, and stains may be generated, and the stability of the chemical conversion solution may be reduced.

Phosphorus (P) may adhere to the surface of the steel sheet in a content of, in detail, 0.01 to 10 mg/m$^2$. When a coating weight of P is less than 0.01 mg/m$^2$, sufficient phosphatability and yellowing resistance may not be exhibited. When the coating weight of P is greater than 10 mg/m2, the steel sheet may be stained and the surface of the steel sheet may be rather dark.

Carbon (C) may adhere to the surface of the steel sheet in a content of, in detail, 0.01 to 20 mg/m$^2$. When a coating weight of C is less than 0.01 mg/m$^2$, sufficient yellowing resistance may not be exhibited. When the coating weight of C is greater than 20 mg/m$^2$, surface appearance may become poor and phosphatability of a subsequent process may be deteriorated.

The steel sheet according to an example embodiment may contain O together with Ca, Mg, P, and C, and O may adhere in a content of, in detail, 0.05 to 30 mg/m$^2$. When a coating weight of O is less than 0.05 mg/m$^2$, sufficient yellowing resistance may not be exhibited. When the coating weight of O is greater than 30 mg/m$^2$, yellowing may become severe to result in poor surface appearance, and phosphatability may be deteriorated in a subsequent process.

According to another example embodiment, the steel sheet may further include nitrogen (N), chlorine (Cl), fluorine (F), sodium (Na), aluminum (Al), silicon (Si), sulfur (S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in addition to Ca, Mg, P, C, and O. Among the above components, one type of component may be contained, and two or more types of component may be contained.

In this case, a total coating weight of N, Cl, F, Na, Al, Si, S, K, Ti, V, Cr, Mn, Co, Ni, Fe, Cu, Zn, Zr, and Mo may be 10 mg/m$^2$ or less (excluding 0). When the total coating weight of the additional components is greater than 10 mg/m$^2$, the surface appearance of the steel sheet may become poor due to the generation of stains on the surface of the steel sheet.

As the coverage of the phosphate film formed by a phosphate treatment is lower than about 90% or less, paintability may be reduced. However, in the steel sheet according to an example embodiment, predetermined amounts of Ca, Mg, P, C, and O may adhere to the surface of the steel sheet dried after water-cooling and water-rinsing to achieve 90% or more of excellent coverage of the phosphate film when the phosphate treatment is performed, as described above.

In addition, predetermined amounts of Ca, Mg, P, C, and O may adhere to a surface of a cold-rolled steel sheet according to an example embodiment dried after water-cooling and water-rising, as described above, to suppress yellowing of the steel sheet during the water-cooling and the water-rising. Quality of an anti-yellowing treated steel sheet may be a value measured by a colorimeter (Minolta Spectrophotometer, CM3700d), and a yellowness index of a surface of the steel sheet may be, in detail, 3 or less. When the yellowness index of the surface of the steel sheet has a low value of 3 or less, the surface appearance may be excellent. Meanwhile, when the yellowness index is greater than 3, the surface appearance may be poor due to severe yellowing, and phosphatability of a subsequent process may be deteriorated.

As described above, the cold-rolled steel sheet having excellent phosphatability and yellowing resistance according to an example embodiment may effectively suppress formation of an oxide film on the steel sheet during water-cooling or water-rinsing and may form a film promoting phosphate nucleation. Therefore, the cold-rolled steel sheet may be applied to a process of manufacturing a steel sheet subjected to water-cooling and water-rinsing, such as a hot-rolled pickling process, a hot-rolled pickling oiling process, a hot-rolled pickling plating process, a continuous annealing process, a stainless steel process, a hot-dip plating process, and a hot-dip galvanizing process.

Such a cold-rolled steel sheet having excellent phosphatability and yellowing resistance may be manufactured by cooling or rinsing the steel sheet with water by applying a chemical treatment solution composition, which may provide Ca, Mg, P, C, and O in the same coating weight as described above, to a surface of the steel sheet.

As described above, by adding a phosphate treatment accelerator and an oxidation inhibitor composition to cooling water and rinsing water cooling or rising the steel sheet with after annealing, a cold-rolled steel sheet having excellent phosphatability and yellowing resistance may be manufactured. In this case, the cold-rolled steel sheet provided by the present disclosure may be obtained by allowing above-mentioned Ca, Mg, P, C, and O to remain in predetermined amounts on the surface of the steel sheet. The contents of Ca, Mg, P, C and O adhering to the surface of the steel sheet may be obtained by appropriately adjusting the composition in the cooling water or the rinsing water. In addition, the contents of Ca, Mg, P, C and O adhering to the surface of the steel sheet may be obtained by adjusting the treatment conditions of a cooling process and a water-rinsing process, for example, a time, a temperature, a concentration, and the like. As described, when Ca, Mg, P, C, and O may adhere in the above-described contents, the method is not limited.

For example, an aqueous solution including 1 to 5 wt % of calcium chloride, 1 to 5 wt % of magnesium chloride, 5 to 15 wt % of phosphate ester, 5 to 15 wt % of ethylamine, 2 to 10 wt % of sodium carbonate, 1 to 10 wt % of ammonium acetate %, 0.1 to 2 wt % of an oxidation inhibitor, and a balance of solvent may be applied to at least one of the water-rising process and the water-cooling process of the steel sheet to manufacture a cold-rolled steel sheet having excellent phosphatability and yellowing resistance. The solvent of the water-rinsing composition may be distilled water or water, or distilled water or water containing a small amount of surfactant.

The oxidation inhibitor is not limited, but may be at least one selected from the group consisting of a phosphoric acid ester compound, an amine compound, a carbonate compound, a glycol compound, and an acetate compound.

According to another aspect of the present disclosure, a method of manufacturing a surface-treated steel sheet on the above-described steel sheet having excellent yellowing resistance and phosphatability is provided. The method may include the following treatment operations (1) to (6) and similar treatment operations.

(1) forming a flash plating layer including at least one of nickel (Ni), iron (Fe), copper (Cu), or zinc (Zn) on a steel sheet having improved yellowing resistance and phosphatability;

(2) forming a phosphating layer on the steel sheet having improved yellowing resistance and phosphatability;

(2) forming a phosphating layer on the steel sheet having improved yellowing resistance and phosphate treatment;

(3) plating at least one of zinc (Zn), aluminum (Al), magnesium (Mg), and silicon (Si) on the steel sheet having improved yellowing resistance and phosphatability by hot-dip plating or electroplating;

(4) applying rust preventive oil to the steel sheet having improved yellowing resistance and phosphate treatment;

(5) applying a resin composition to the steel sheet having improved yellowing resistance and phosphatability to form a resin layer;

(6) applying paint to the steel sheet having improved yellowing resistance and phosphatability to form a coating.

Accordingly, in the cold-rolled steel sheet according to an example embodiment, at least one of a flash plating layer including at least one of Ni, Fe, Cu, and Zn on the steel sheet; a phosphating layer; a plating layer containing at least one of Zn, Al, Mg, and Si; an anti-rust oil layer; a resin layer; and a coating layer may be formed on the steel sheet.

MODE FOR INVENTION

Hereinafter, the present disclosure will be described in more detail with respect to the following examples. The following examples are merely examples to help in understanding the present disclosure, not to limit the scope of the present disclosure.

EXAMPLES

Experimental Examples 1 to 4

Specimens used in Experimental Examples 1 to 4 were specimens prepared to have a size of 100 mm×100 mm (width length) by cutting a cold-rolled steel sheet having tensile strength of 980 MPa and a thickness of 1.0 mm and containing 1.1 wt % of Si and Mn as illustrated in Table 1 below as a composition of the steel sheet.

The specimens were immersed in 500 ml (80° C.) of hydrochloric acid at a concentration of 5 wt % for 5 seconds to be picked, and then rinsed with distilled water. A yellowness index of each of the pickled and rinsed specimens was measured using a colorimeter (Minolta Spectrophotometer, CM3700d), and yellowing resistance thereof was evaluated depending on whether yellowing occurred. Criteria of the evaluation are, as follows.

○—yellowing resistance is present: when a yellowness index is 3 or less x—yellowing resistance is absent: when a yellowness index is greater than 3

Each of the pickled and rinsed specimens was subjected to surface conditioning under the following conditions, and then subjected to a phosphate treatment.

Surface conditioning: chemical name: PL-Z (DAEHAN PARKERIZING CO., LTD.), concentration pH: 7.5 to 11, treatment time: 21 seconds, and surface conditioning solution temperature: 25 to 35° C.

Phosphating treatment: chemical name: PB-37 (DAEHAN PARKERIZING CO., LTD.), free acidity: 0.6 to 1 point, treatment time: 80 seconds, and phosphating solution temperature: 40 to 45° C.

In each of the specimens subjected to the phosphate treatment under the above conditions, an adhesion state of phosphate particles was observed with a scanning electron microscope (SEM), and coverage of phosphate particles was measured using an image analyzer to evaluate phosphatability. In this case, the evaluation of phosphatability was performed based on the following criteria.

○—good phosphatability: coverage is 90% or more x—poor phosphatability: coverage is less than 90%

Results of yellowing resistance and phosphatability are listed in Table 1 below.

TABLE 1

| | Specimen steel composition (wt %) | | Quality Characteristics | |
|---|---|---|---|---|
| Classification | Specimen No. | Mg | Phosphatability | Yelling Resistance |
| Experimental Example 1 | Specimen 1 | 0.3 | ○ | ○ |
| Experimental Example 12 | Specimen 2 | 0.5 | X | X |
| Experimental Example 13 | Specimen 3 | 2.8 | X | X |
| Experimental Example 14 | Specimen 4 | 3.5 | X | X |

As illustrated in Table 1, in the case of Specimen 1 containing less than 0.5 wt % of manganese in a composition of steel components, no yellowing occurred, so yellowing resistance was exhibited and phosphatability was excellent. On the other hand, in the case of Experimental Examples 2 to 4 for Specimens 2 to 4 in which manganese was contained in a content of 0.5 wt % or more, yellowing occurred and the phosphatability was reduced. From the results, it can be confirmed that the steel containing 0.5 wt % or more of manganese needs to be provided with yellowing prevention capability by a yellowing prevention treatment.

Examples 1 to 15 and Comparative Examples 1 to 8

By using the same specimen 3 as the specimen used in Experimental Example, pickling and water-rinsing were performed under the same conditions as in Experimental Example 3 containing 3.8 wt % of Mn. In this case, water-rinsing was performed by immersing the specimens in 500 ml of a rinsing solution, prepared as below, for 10 seconds, rather than distilled water of Experimental Example 3.

A rinsing solution, basically used as the rinsing solution, was a rinsing solution prepared by adding 0.5 wt % of a chemical conversion solution for improving yellowing resistance and phosphatability to distilled water. The chemical conversion solution contained 3 wt % of calcium chloride, 3 wt % of magnesium chloride, 10 wt % of phosphoric acid ester, 8 wt % of ethylamine, 6 wt % of sodium carbonate, 5 wt % of ammonium acetate and a small amount of a balance of surfactant.

By performing water-rinsing by appropriately changing the content of one or two or more of components of the rinsing solution, coating weights of components adhering to the surface of the steel sheet, except for the steel component, were variously adjusted as illustrated in Table 2. In this case, the contents of Ca, Mg, P, C, and O, excluding the steel component adhering to the surface of each steel sheet, were determined by a wet method, a fluorescence X-ray analyzer (XRF), a glow discharge spectroscopy (GDS), an energy dispersive spectroscopy (EDS), and the like, and results thereof are listed in Table 2 below. According to the coating weight of each of the components, the respective specimens were sequentially listed in Table 2, and yellowing resistances in the respective specimens were also listed in Table 2.

On the other hand, when a chemical conversion treatment was performed using a phosphatability improver and an oxidation inhibitor, there were additionally adhering components such as Cl, N, Na, S, and the like, in addition to Ca, Mg, P, C, and O. However, a small amount of each of the additionally adhering components did not have a significant effect on phosphatability and oxidation resistance or did not have a constant tendency. Therefore, the additionally adhering components were listed as other components in the present example.

Next, after performing surface conditioning and a phosphate treatment on a surface of each water-rinsed specimen by the same method as in Experimental Example 1, phosphatability was then evaluated by the same method as in Experimental Example 1 and surface appearance characteristics were evaluated by a method below. Evaluation results are listed in Table 2.

The surface appearance characteristics were evaluated based on the following criteria by observing the surfaces of the water-rinsed specimens by naked eyes and phosphate-treated specimens and depending on whether stains were generated, in each of Examples and Comparative Examples.

○—good surface appearance: no stains

Δ—average surface appearance: minute stains, but acceptable for sale x—poor surface appearance: severe stains

TABLE 2

| | Steel Surface Coating Weight ($mg/m^2$) | | | | | Quality Characteristics | | |
|---|---|---|---|---|---|---|---|---|
| Classification | Ca + Mg | P | C | O | Other Components | Yellowing prevention capability | Phosphatability | Surface Appearance |
| Comparative Example 1 | 0 | 0.5 | 1.1 | 2 | 0 | Δ | x | Δ |

TABLE 2-continued

| Classification | Steel Surface Coating Weight (mg/m²) Ca + Mg | P | C | O | Other Components | Quality Characteristics Yellowing prevention capability | Phosphatability | Surface Appearance |
|---|---|---|---|---|---|---|---|---|
| Example 1 | 0.01 | 0.5 | 1.1 | 2 | 0 | ○ | Δ | ○ |
| Example 2 | 0.5 | 0.5 | 1.1 | 2 | 0 | ○ | ○ | ○ |
| Example 3 | 10 | 0.5 | 1.1 | 2 | 0 | ○ | ○ | ○ |
| Comparative Example 2 | 15 | 0.5 | 1.1 | 2 | 0 | ○ | ○ | x |
| Comparative Example 3 | 0.5 | 0.005 | 1.1 | 2 | 0 | Δ | x | Δ |
| Example 4 | 0.5 | 0.01 | 1.1 | 2 | 0 | ○ | ○ | Δ |
| Example 5 | 0.5 | 0.5 | 1.1 | 2 | 0 | ○ | ○ | Δ |
| Example 6 | 0.5 | 10 | 1.1 | 2 | 0 | ○ | ○ | Δ |
| Comparative Example 4 | 0.5 | 15 | 1.1 | 2 | 0 | x | ○ | x |
| Comparative Example 5 | 0.5 | 0.5 | 0.005 | 2 | 0 | x | x | Δ |
| Example 7 | 0.5 | 0.5 | 0.01 | 2 | 0 | ○ | ○ | Δ |
| Example 8 | 0.5 | 0.5 | 1.1 | 2 | 0 | ○ | ○ | Δ |
| Example 9 | 0.5 | 0.5 | 20 | 2 | 0 | ○ | ○ | Δ |
| Comparative Example 6 | 0.5 | 0.5 | 30 | 2 | 0 | ○ | x | x |
| Example 10 | 0.5 | 0.5 | 1.1 | 0.05 | 0 | ○ | ○ | Δ |
| Example 11 | 0.5 | 0.5 | 1.1 | 2 | 0 | ○ | ○ | Δ |
| Example 12 | 0.5 | 0.5 | 1.1 | 30 | 0 | ○ | ○ | Δ |
| Comparative Example 7 | 0.5 | 0.5 | 1.1 | 40 | 0 | x | x | x |
| Example 13 | 0.5 | 0.5 | 1.1 | 2 | 0.01 | ○ | ○ | ○ |
| Example 14 | 0.5 | 0.5 | 1.1 | 2 | 0.5 | ○ | ○ | ○ |
| Example 15 | 0.5 | 0.5 | 1.1 | 2 | 10 | ○ | ○ | Δ |
| Comparative Example 8 | 0.5 | 0.5 | 1.1 | 2 | 15 | ○ | Δ | x |

As can be seen from Table 2, Ca+Mg adhered to surfaces of specimens, having phosphatability and yellowing resistance after water-rinsing washing, within a range of 0.01 to 10 mg/m2, and P adhered thereto within a range of 0.01 to 10 mg/m2, C adhered thereto within a range of 0.01 to 20 mg/m2, O adhered thereto within a range of 30 mg/m2 or less, and other components adhered thereto within a range of 10 mg/m2 or less. In addition, the specimens having components within such ranges were evaluated to have good surface appearance. However, in Comparative Example 1 in which Ca+Mg was less than 0.01 mg/m2, Comparative Example 3 in which a coating weight of P was less than 0.01 mg/m2, and Comparative Example 5 in which a coating weight of C was less than 0.01 m, a yellowness index was measured to be greater than 3 or a phosphate coverage was measured to be less than 90%, yellowing resistance and phosphatability were poor.

On the other hand, in Comparative Examples 2, 4, 6, 7 and 8 in which coating weights of Ca+Mg, P, C, O, or other components were greater than a range limited by the present disclosure, at least one of quality characteristics such as phosphatability, yellowing resistance, and surface appearance was rather deteriorated.

From the above results, it can be seen that when the contents of Ca+Mg, P, C, and O adhering to the surface of the steel sheet after water-rinsing are within the range proposed in the present disclosure, not only the phosphatability but also the yellowing resistance were excellent.

In Examples 13 to 15 and Comparative Example 8, quality characteristics of specimens were evaluated when other components such as Cl, N, Na, and S additionally adhered to surfaces of the specimens while contents of Ca+Mg, P, C, and O adhered thereto after water-rinsing were within a range of the present disclosure. In the case of Examples 13 to 15, phosphatab8iliyt, yellowing resistance, and surface appearance were all excellent.

Meanwhile, as in Comparative Example 8, when a total coating weight of other components was greater 10 mg/m², severe stains were observed on the surface of the steel sheet. Therefore, other components may preferably adhere to a surface of a water-rinsed steel sheet, but it may be confirmed that a preferable effect is obtained only when a content thereof is not greater than 10 mg/m².

To confirm a relationship between surface appearance and surface chromaticity, yellowness indices were measured from Comparative Examples 4, 6 and 7, exhibiting poor surface appearance, and Examples 2, 5, and 14 exhibiting good surface appearance, independently of solution stability, and results thereof are listed in Table 3.

TABLE 3

| Classification | Surface Chromaticity Yellowness Index | Quality Characteristics Yellowing Prevention Capability | Phosphatability | Surface Appearance |
|---|---|---|---|---|
| Comparative Example 4 | 3.8 | X | ○ | X |
| Comparative Example 6 | 3.5 | ○ | X | X |
| Comparative Example 7 | 4.1 | X | X | X |
| Example 2 | 1.0 | ○ | ○ | ○ |
| Example 4 | 3.0 | ○ | ○ | Δ |
| Example 14 | 2.0 | ○ | ○ | ○ |

As can be seen from Table 3, when surface chromaticity of a steel sheet after water-rinsing satisfies 3.0 or less, a range of the present disclosure, phosphatability, yellowing resistance, and surface appearance are excellent.

Examples 16 to 18 and Comparative Examples 9 to 10

Examples 16 to 18 and Comparative Examples 9 to 10 are examples in which cold-rolled steel sheet manufacturing conditions which did not include a post-treatment process, for example, an annealed steel sheet was cooled in a water-cooling section, exited an annealing furnace, and then was subjected to temper rolling and oiling to be a cold-rolled steel sheet. An effect on phosphatability and yellowing resistance was evaluated based on the above-mentioned criteria by a method of cooling by composing a chemical conversion solution in cooling water of the water-cooling section in the same manner as in Example 1, and the evaluation results are listed in Table 4.

TABLE 4

| | Steel Surface Coating Weight ($mg/m^2$) | | | | | Quality Characteristics | | |
|---|---|---|---|---|---|---|---|---|
| | | | | | | Yellowing Prevention | | Surface |
| Classification | Ca + Mg | P | C | O | Others | Capability | Phosphatability | Appearance |
| Comparative Example 9 | 0.5 | 0.005 | 1.1 | 2 | 0 | ○ | x | Δ |
| Example 16 | 0.5 | 0.01 | 1.1 | 2 | 0 | ○ | ○ | Δ |
| Example 17 | 0.5 | 0.5 | 1.1 | 2 | 0 | ○ | ○ | Δ |
| Example 18 | 0.5 | 10 | 1.1 | 2 | 0 | ○ | ○ | Δ |
| Comparative Example 10 | 0.5 | 15 | 1.1 | 2 | 0 | Δ | ○ | x |

Referring to Table 4, even when applied to a general cold-rolling process having only a water-cooling section without a post-treatment process, contents of Ca+Mg, P, C, and O adhering to a surface of a steel sheet after water-rising within the range proposed by the present disclosure. In this case, it may be seen that phosphatability, yellowing resistance, and surface appearance are satisfactory. While example embodiments have been shown and described above, it will be apparent to those skilled in the art that modifications and variations could be made without departing from the scope of the present disclosure as defined by the appended claims.

The invention claimed is:

1. A plated steel sheet having improved yellowing resistance and phosphatability, comprising: a steel sheet containing 0.5 wt % or more and 3.5 wt % or less of manganese (Mn);

a surface-adhered layer formed on the steel sheet;

a plating layer formed on the surface-adhered layer;

wherein the surface-adhered layer contains magnesium (Mg);

wherein the surface-adhered layer contains 0.01 to 10 $mg/m^2$ of calcium (Ca)+magnesium (Mg), 0.01 to 10 $mg/m^2$ of phosphorous (P), 0.01 to 20 $mg/m^2$ of carbon (C), and 0.05 to 30 $mg/m^2$ of oxygen (O) as components excluding a steel component on a surface of the steel sheet after pickling, water-rinsing, and drying.

2. The plated steel sheet of claim 1, wherein the steel sheet having a surface-adhered layer formed thereon has a yellowness index of 3.0 or less.

3. The plated steel sheet of claim 1, wherein the surface-adhered layer further contains at least one selected from the group consisting of nitrogen (N), chlorine (Cl), fluorine (F), sodium (Na), aluminum (Al), silicon (Si), sulfur(S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in a content of 10 $mg/m^2$ or less (excluding 0), excluding the steel component.

4. A method of manufacturing a surface-treated steel sheet on the steel sheet having improved yellowing resistance and phosphatability of claim 1, the method comprising:

(1) forming a flash plating layer including at least one of nickel (Ni), iron (Fe), copper (Cu), or zinc (Zn) on a steel sheet having improved yellowing resistance and phosphatability;

(2) forming a phosphating layer on the steel sheet having improved yellowing resistance and phosphatability;

(3) plating at least one of zinc (Zn), aluminum (Al), magnesium (Mg), and silicon (Si) on the steel sheet having improved yellowing resistance and phosphatability by hot-dip plating or electroplating;

(4) applying rust preventive oil to the steel sheet having improved yellowing resistance and phosphate treatment;

(5) applying a resin composition to the steel sheet having improved yellowing resistance and phosphatability to form a resin layer; and (6) applying paint to the steel sheet having improved yellowing resistance and phosphatability to form a coating layer.

5. The method of claim 4, wherein a yellowness index of the steel sheet is 3.0 or less.

6. The method of claim 4, further containing at least one selected from the group consisting of nitrogen (N), chlorine (Cl), fluorine (F), sodium (Na), aluminum (Al), silicon (Si), sulfur(S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in a content of 10 $mg/m^2$ or less (excluding 0), excluding the steel component on the surface of the steel sheet.

7. A plated steel sheet having improved yellowing resistance and phosphatability, comprising: a steel sheet containing 0.5 wt % or more and 3.5 wt % or less of manganese (Mn);

a surface-adhered layer formed on the steel sheet;

a plating layer formed on the surface-adhered layer;

wherein the surface-adhered layer contains magnesium (Mg);

wherein the surface-adhered layer contains 0.01 to 10 $mg/m^2$ of calcium (Ca)+magnesium (Mg), 0.01 to 10 $mg/m^2$ of phosphorus (P), 0.01 to 20 $mg/m^2$ of carbon (C), and 0.05 to 30 mg/m$^2$ of oxygen (O) as components excluding a steel component on a surface of the steel sheet after annealing, water-cooling, and drying.

8. The plated steel sheet of claim 7, wherein the steel sheet having a surface-adhered layer formed thereon has a yellowness index of 3.0 or less.

9. The plated steel sheet of claim 7, wherein the surface-adhered layer further contains at least one selected from the group consisting of nitrogen (N), chlorine (Cl), fluorine (F), sodium (Na), aluminum (Al), silicon (Si), sulfur(S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in a content of 10 mg/m$^2$ or less (excluding 0), excluding the steel component.

10. A method of manufacturing a surface-treated steel sheet on the steel sheet having improved yellowing resistance and phosphatability of claim 7, the method comprising:

(1) forming a flash plating layer including at least one of nickel (Ni), iron (Fe), copper (Cu), or zinc (Zn) on a steel sheet having improved yellowing resistance and phosphatability;

(2) forming a phosphating layer on the steel sheet having improved yellowing resistance and phosphatability;

(3) plating at least one of zinc (Zn), aluminum (Al), magnesium (Mg), and silicon (Si) on the steel sheet having improved yellowing resistance and phosphatability by hot-dip plating or electroplating;

(4) applying rust preventive oil to the steel sheet having improved yellowing resistance and phosphate treatment;

(5) applying a resin composition to the steel sheet having improved yellowing resistance and phosphatability to form a resin layer; and (6) applying paint to the steel sheet having improved yellowing resistance and phosphatability to form a coating layer.

11. The steel sheet of claim 10, wherein a yellowness index of the steel sheet 13.0 or less.

12. The steel sheet of claim 10, wherein a yellowness index of the steel sheet is 3.0 The steel sheet of claim 10, further containing at least one selected from the group consisting of nitrogen (N), chlorine (Cl), fluorine (F), sodium (Na), aluminum (Al), silicon (Si), sulfur(S), potassium (K), titanium (Ti), vanadium (V), chromium (Cr), manganese (Mn), cobalt (Co), nickel (Ni), iron (Fe), copper (Cu), zinc (Zn), zirconium (Zr), and molybdenum (Mo), in a content of 10 mg/m$^2$ or less (excluding 0), excluding the steel component on the surface of the steel sheet.

* * * * *